United States Patent [19]

Mifune et al.

[11] 4,377,635

[45] Mar. 22, 1983

[54] PHOTOGRAPHIC LIGHT-SENSITIVE MATERIAL

[75] Inventors: Hiroyuki Mifune; Nobuaki Inoue, both of Minami-ashigara; Yoshiharu Fuseya, Odwara, all of Japan

[73] Assignee: Fuji Photo Film Co., Ltd., Kanagawa, Japan

[21] Appl. No.: 382,980

[22] Filed: May 28, 1982

[30] Foreign Application Priority Data

May 28, 1981 [JP] Japan ..... 56-81503

[51] Int. Cl.[3] ..... E03C 1/02; E03C 1/28

[52] U.S. Cl. ..... 430/564; 430/567; 430/569; 430/599

[58] Field of Search ..... 430/564, 599, 607, 606, 430/567, 569

[56] References Cited

U.S. PATENT DOCUMENTS

| | | | |
|---|---|---|---|
| 2,666,700 | 1/1954 | Dewey | 430/599 |
| 3,026,203 | 3/1962 | Chambers et al. | 430/599 |
| 3,486,901 | 12/1969 | Karlson | 430/607 |
| 4,272,632 | 6/1981 | Sachdev et al. | 430/599 |

*Primary Examiner*—Mary F. Downey

*Attorney, Agent, or Firm*—Sughrue, Mion, Zinn, Macpeak & Seas

[57] ABSTRACT

A photographic light-sensitive material which has on a support at least one silver halide emulsion layer containing large-size silver halide grains formed in the presence of at least one compound acting as a silver halide solvent and having the following general formual (I):

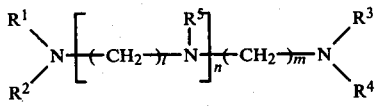

(I)

wherein l and m each represents an integer of 2 or 3; n represents zero or an integer of 1 or 2; and $R^1$ and $R^5$ may be the same as or different from one another, each being an alkyl group, a hydroxyalkyl group or carboxyalkyl group, and when n equals zero, at least one of the substituents of $R^1$ to $R^4$, must be a hydroxyalkyl group, while when n does not equal zero, at least two of the substitutents of $R^1$ to $R^5$, must be hydroxyalkyl groups. Use of the compound of the present invention results in emulsions exhibiting excellent reproducibility with respect to gain sizes of silver halides.

7 Claims, No Drawings

PHOTOGRAPHIC LIGHT-SENSITIVE MATERIAL

FIELD OF THE INVENTION

The present invention relates to a photographic light-sensitive material and more particularly, to a photographic light-sensitive material in which a silver halide emulsion containing silver halide grains formed in the presence of a novel silver halide solvent is employed.

BACKGROUND OF THE INVENTION

A silver halide emulsion used in a photographic light-sensitive material is generally produced by the sequential steps of: (1) mixing a silver ion solution and a halogen ion solution in the presence of a protective colloid (which is called the precipitating step hereinafter); (2) subjecting the resulting precipitates to a physical ripening or the Ostwald ripening processing (which is called the physical ripening step hereinafter); (3) removing useless salts by washing with water; (4) redispersing the thus obtained silver halide grains; and (5) subjecting them to various chemical ripening processings depending upon the end-use purposes of the silver halide emulsion. Grain size of silver halides, which is one of the actors controlling the photographic sensitivity of a silver halide emulsion, is decided for the most part in the above-described precipitating and physical ripening steps (which are collectively called the grain forming step hereinafter). In order to grow silver halide grains in a greater size, there are cases where silver halide solvents are added in this grain forming step. The most typical silver halide solvent is ammonia, and the silver halide grain forming method using ammonia is called the ammonia process. However, ammonia aggravates working circumstances to a great extent due to its pungent odor. Furthermore, the reproducibility of the result obtained when the grain forming step in the presence of ammonia is carried out at a high temperature is poor due to the high volatility of ammonia (that is, even if grain formation is repeated several times under the same condition, silver halide grains have different sizes every time they are formed). In addition, ammonia may cause fog.

SUMMARY OF THE INVENTION

Therefore, one object of the present invention is to provide a photographic light-sensitive material provided with a silver halide emulsion layer which contains silver halide grains having large grain sizes obtained by using a novel silver halide solvent.

Another object of the present invention is to provide a method for forming silver halide grains in which their grain sizes can be increased without aggravating the working circumstances due to offensive odors.

A further object of the present invention is to provide a method for forming silver halide grains having large grain sizes with good reproducibility even under high temperature condition.

Still another object of the present invention is to provide a method for forming silver halide grains having large grain sizes thus greatly reducing fog.

The above-described objects of the present invention are attained with the photographic light-sensitive material of this invention.

The material is composed of a support with a silver halide emulsion layer containing silver halide grains formed in the presence of at least one compound (silver halide solvent) represented by the following general formula (I). The latter three objects are achieved by carrying out the precipitating or/and the physical ripening steps in the presence of a compound represented by the following general formula (I):

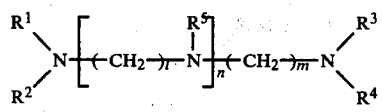

(I)

wherein l and m each represents an integer of 2 or 3; n represents zero or an integer of 1 or 2; and $R^l$ or $R^5$ may be the same or different from one another, each being an alkyl group, a hydroxyalkyl group or a carboxyalkyl group, and when n is zero, at least one substituents of $R^1$ to $R^4$, must be a hydroxyalkyl group, while when n is not zero, at least two substituents of $R^1$ to $R^5$, must be hydroxyalkyl groups.

DETAILED DESCRIPTION OF THE INVENTION

Preferable alkyl groups represented by the substituents $R^1$ to $R^5$ in the general formula (I) include those which have 6 or less carbon atoms, such as methyl, ethyl and the like. Preferable hydroxyalkyl groups represented by the substituents $R^1$ to $R^5$ include those which have 6 or less carbon atoms, such as 2-hydroxyethyl, 2-hydroxypropyl, 3-hydroxypropyl, 2-hydroxybutyl, 4-hydroxybutyl and the like. Preferable carboxyalkyl groups represented by the substituents $R^1$ to $R^5$ include those which have 2 to 7 carbon atoms, such as carboxymethyl, 2-carboxyethyl and the like. The compound represented by the general formula (I) becomes more effective the more the number of the substituent representing a hydroxyalkyl group is. Accordingly, the compounds in which all of the substituents, $R^1$ to $R^4$, or $R^1$ to $R^5$, represent hydroxyalkyl groups respectively are the most preferable ones. As for the substituents, other than hydroxyalkyl groups, alkyl groups are preferable to carboxyalkyl groups.

Most of the compounds represented by the general formula (I), as well as the compounds represented by the following general formula (II), function effectively as a silver halide solvent:

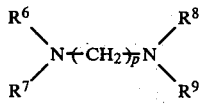

(II)

wherein p represents an integer of 2 or 3, preferably 2; and $R^6$ to $R^9$ may be different from one another, but at least one of them must be a hydroxyalkyl group (, preferably that which has 6 or less carbon atoms, e.g., 2-hydroxyethyl, 2-hydroxypropyl, 3-hydroxypropyl, 2-hydroxybutyl, 4-hydroxybutyl, etc.) and the residual substituents represent alkyl groups (, preferably having 6 or less carbon atoms, e.g., methyl, ethyl, etc.). The compounds represented by the general formula (II) become more effective the more the number of the substituent representing a hydroxyalkyl group is. When all of the substituents $R^6$ to $R^9$ represent hydroxyalkyl groups respectively, they become the most preferable ones.

Specific examples of the silver halide solvent represented by the general formula (I) and/or the general formula (II) are illustrated below.

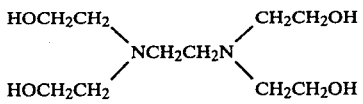
Compound (1)

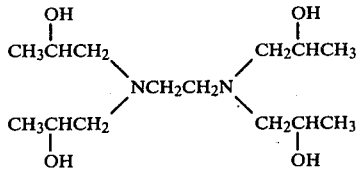
Compound (2)

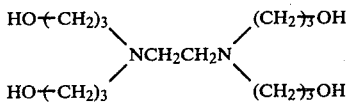
Compound (3)

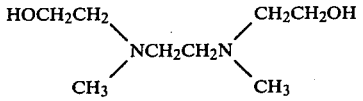
Compound (4)

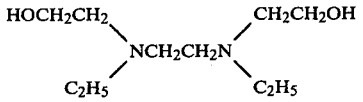
Compound (5)

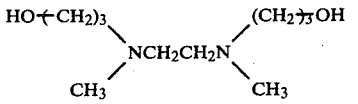
Compound (6)

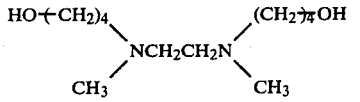
Compound (7)

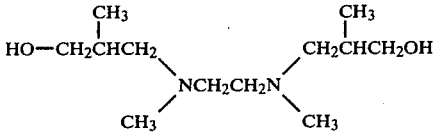
Compound (8)

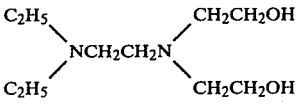
Compound (9)

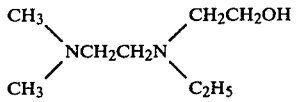
Compound (10)

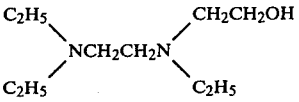
Compound (11)

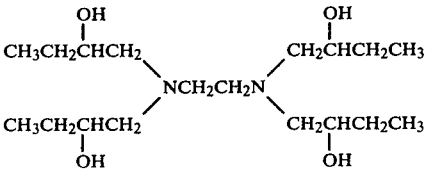
Compound (12)

-continued

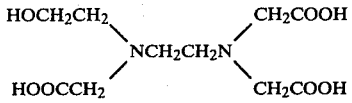
Compound (13)

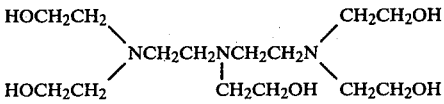
Compound (14)

The existence of the compounds of the general formula (I) to be employed in the present invention and methods for synthesizing them are known. These compounds are generally synthesized by making alkylene dihalides act on alkylaminoalkanols or dialkanolamines.

The methods for synthesizing such compounds are specifically described in more detail in G. Faust & W. Fiedler, *Journal of Practical Chemistry,* vol. 21, pp. 113–130 (1963), K. Schloegl & R. Schloegl, *Monatshefte Fur Chemie,* vol. 95, pp. 922–941 (1964), K. Nakajima, *Bulletin of the Chemical Society of Japan,* vol. 34, pp. 651–654 (1961), U.S. Pat. No. 3,144,451 incorporated herein by reference to disclose methods of synthesizing the compounds. Some of these compounds are on the market today.

There are cases where these types of silver halide solvents have been used as dispersing agents or stabilizers for subbing layers of photographic light-sensitive materials, or as agents for preventing photographic light-sensitive materials from generating spots due to the presence of metallic powders or the like, as described in, e.g., Germany Pat. No. 1,233,723. However, such compounds, of the above-described kind, have not previously been used as additives in order to form silver halide grains (as silver halide solvents), as is intended in the present invention. Further, there are other cases where ethylenediaminetetraacetic acid or polyamines having as substituents carboxyalkyl groups alone, e.g., diethylenetriamine-N,N,N′,N″,N″-pentaacetic acid, triethylenetetramine-N,N,N′,N″,N″,N‴-hexaacetic acid and 1,2-diaminocyclohexane-N,N,N′,N′-tetraacetic acid as described in British Pat. No. 1,221,137 have been used as silver halide solvents with the same intention as in the present invention. However, such uses have resulted in the formation of fog or aggregates in the emulsions. On the other hand, the polyamines having hydroxyalkyl groups (represented by the general formula (I)) employed in the present invention do form aggregates or cause fog formation.

A silver halide emulsion used in the present invention is contains silver halide grains formed in the presence of a silver halide solvent having the general formula (I).

The emulsion of the present invention is preferably made by reacting a water soluble silver salt with water soluble halides in a liquid reaction medium (e.g., an aqueous solution of a hydrophilic colloid) containing a silver halide solvent represented by the general formula (I).

The silver halide solvent represented by the general formula (I) may be added in any step where the silver halide grains are forming i.e. until they have their final sizes and shapes.

The above-described solvent may be added directly to a colloidal substance where the silver halides are precipitated, or it may be added thereto in combination with any of water soluble salts to be employed for producing silver halides, either of water soluble silver salts (e.g., silver nitrate) or water soluble halides (e.g., alkali metal halides such as potassium bromide, sodium chloride and the like). Further, it may be added prior to or during the physical ripening step.

An additional amount of the silver halide solvent of the general formula (I) employed in the present invention can be varied over a wide range depending on the effect desired, the compounds utilized and so on. As a guide, from about $10^{-4}$ mole to about 5 mole of the compound represented by the general formula (I), per mole of silver halide, can be added to effect the objects of the present invention. Especially good results are obtained when the compound of the present invention is added in the range of from about $10^{-3}$ mole to about 2.5 mole per mole of silver halide.

Moreover, the compound of the present invention can be used in combinations with previously known silver halide solvents (e.g., ammonia, potassium thiocyanate, compounds described in U.S. Pat. No. 3,271,157; published unexamined Japanese patent applications Nos. 12360/76, 82408/78, 144319/78, 100717/79 and 155828/78; and so on) according to the end-use purpose of a photographic light-sensitive material to be prepared.

Examples of useful methods for making emulsions employed in the present invention, include those described in P. Glafkides, Chimie et Physique Photographique, Paul Montel, Paris (1967), G. F. Duffin, *Photographic Emulsion Chemistry,* The Focal Press (1966), V. L. Zelikman et al., *Making and Coating Photographic Emulsion,* The Focal Press (1964).

The reaction of a water soluble silver salt with a water soluble halide can be effected using methods such as a single jet method, a double jet method, a combination of these methods and so on.

In addition a method which involves maintaining the value of pAg in the liquid phase constant while silver halides are under production can be used. This method is referred to as a controlled double jet method.

The steps of making the emulsion of the present invention are carried out at a temperature ranging generally from about 30° C. to 90° C., in a pH range of preferably from about 5 to 10. However, there are no special restrictions as to the pH value, and in a pAg range of from about 6 to 13 though its optimum value depends upon the temperature.

The silver halide grain forming step or the physical ripening stpe may be carried out in the presence of a cadmium salt, a zinc salt, a lead salt, a thallium salt, an iridium salt or a complex salt thereof, a rhodium salt or a complex salt thereof, an iron salt or a complex salt thereof, or so on.

The composition of silver halides contained in the silver halide emulsions of the present invention may include all conventional silver halides such as: silver bromide, silver iodide, silver chloride, silver chlorobromide, silver bromoiodide and silver chlorobromoiodide.

Good results are obtained when silver halides of photographic silver halide emulsions made in accordance with embodiments of the present invention have a mean grain diameter of about 0.1 micron to about 5 microns, preferably about 0.2 microns to about 3 microns. The mean grain diameter can be determined by conventional methods, for example, the method described in *The Photographic Journal,* vol. 79, pp. 330–338 (1939), or using an electron microscope or an optical microscope.

The inner part and the surface layer of individual silver halide grains may have different phases from each other, or they may have the same and uniform phase. In addition, the grains may form a latent image predominantly at their individual surface parts, or at their individual inner parts.

When making the emulsions of the present invention, soluble salts are generally removed after the precipitate forming step or the physical ripening stpe. As a means for removing the soluble salts, the noodle washing method which has been known for some time has been used. This method comprises gelling the gelatin. It is also possible to use a flocculation process taking advantage of a polyvalent anion-containing inorganic salt (e.g., sodium sulfate), an anionic surface active agent or an anionic polymer (e.g., polystyrene sulfonic acid) or a gelatin derivative (e.g., an aliphatic acylated gelatin, an aromatic acylated gelatin, an aromatic carbamoylated gelatin) or the like. Preferred flocculation processes for this purpose are disclosed in, for example, U.S. Pat. Nos. 2,614,928; 2,618,556; 2,565,418; 2,489,341 and so on. The step of removing soluble salts from the silver halide emulsion may be omitted.

The silver halide emulsion of the present invention can be employed in a so-called primitive emulsion, i.e. a chemically unsensitized emulsion. However, it is usual and preferred for the emulsion of the present invention to be chemically sensitized. Chemical sensitization can be carried out using processes described in P. Glafkides, supra, V. L. Zelikman et al., supra, or H. Frieser, Die *Grundlagen der Photographischen Prozesse mit Silberhalogeniden,* Akademische Verlagsgesellschaft (1968).

The compounds of the present invention may be present at the time of chemical ripening of the silver halide emulsions.

More specifically, sulfur sensitization using compounds containing sulfur capable of reacting with silver ion or active gelatin, reduction sensitization using reducing substances, noble metal sensitization using gold or other noble metal compounds and so on can be employed individually or in combination. Examples of suitable sulfur sensitizers which can be used include thiosulfates, thioureas, thiazoles, rhodanines and other sulfur-containing compounds. Specific examples of sulfur sensitizers are disclosed in U.S. Pat. Nos. 1,574,944; 2,410,689; 2,278,947; 2,728,668 and 3,656,955. Examples of reducing sensitizers include stannous salts, amines, hydrazine derivatives, formamidine sulfinic acid, silane compounds and so on, and specific examples of these sensitizers are disclosed in U.S. Pat. Nos. 2,487,850; 2,419,974; 2,518,698; 2,983,609; 2,983,610 and 2,694,637. Group VIII metal complexes such as those of platinum, iridium, palladium, etc., other than gold metal complexes, can be employed for the purpose of the noble metal sensitization. Specific examples of the noble metal complexes are disclosed in U.S. Pat. Nos. 2,399,083 and 2,448,060; British Pat. No. 618,061; and so on.

The photographic emulsions used in the present invention may be spectrally sensitized with methine dyes or other dyes. Suitable spectral sensitizing dyes which can be employed include cyanine dyes, merocyanine dyes, complex cyanine dyes, complex merocyanine dyes, holopolar cyanine dyes, hemicyanine dyes, styryl dyes, and hemioxonol dyes. Especially useful dyes are cyanine dyes, merocyanine dyes and complex merocyanine dyes.

Useful sensitizing dyes are those dyes described in, for example, German Pat. No. 929,080; U.S. Pat. Nos.

2,231,658; 2,493,748; 2,503,776; 2,519,001; 2,912,329; 3,655,394; 3,656,959; 3,672,897 and 3,694,217: British Pat. No. 1,242,588: and published examined Japanese Patent Application 14030/69.

The silver halide emulsions made in accordance with embodiments of the present invention can be converted to direct positive emulsions by fogging the silver halide grains present therein. Further, direct positive silver halide emulsions with high photographic sensitivity can be obtained by silver halide grains prepared in the presence of the compounds represented by the general formula (I) being doped with metal ions from iridium salts, rhodium salts, lead salts and so on. Also, the silver halide emulsions of the present invention can be doped metal-free direct positive emulsions. The fogging can be attained by treating the silver halide grains chemically or physically using known methods.

The fogged nuclei can be produced by previously fogging chemically the silver halide emulsion used. More specifically, the fogged nuclei can be produced advantageously by addition of inorganic reducing compounds such as stannous chloride, boron hydride, etc., or organic reducing compounds such as hydrazine derivatives, formaldehyde, thiourea dioxide, polyamine compounds, aminoboranes, methyldichlorosilane and so on. For instance, the combination of a reducing agent and a metal ion more noble than silver ion, and the combination of a reducing agent and a halide ion may be employed (which are described in, for example, U.S. Pat. Nos. 2,497,875; 2,588,982; 3,023,102; 3,367,778 and 3,501,307: British Pat. Nos. 707,704; 723,019; 821,251 and 1,097,999: French Pat. Nos. 1,513,840; 739,755; 1,498,213; 1,520,822 and 1,520,824: Belgian Pat. Nos. 708,563 and 720,660: published examined Japanese Patent applications Nos. 13488/68 and 40900/71: and so on).

The silver halide grains can be fogged either before or after the coating thereof on a support in the present invention.

When the emulsions of the present invention are applied to direct positive light-sensitive materials, not only the above-described sensitizing dyes but also desensitizers or desensitizing dyes, and the so-called electron acceptors can be present in the silver halide emulsions. Many useful electron acceptors are described in U.S. Pat. Nos. 3,023,102; 3,314,796; 2,901,351; 3,367,779; 3,501,307 and 3,505,070: British Pat. Nos. 723,019; 698,575; 667,206; 748,681; 698,576; 834,839; 796,873; 875,887; 905,237; 907,367; 940,152; 1,155,404 and 1,237,925: published examined Japanese patent applications Nos. 13167/68, 14500/68 and 23515/71; and so on.

The photographic emulsions of the present invention may contain, for example, polyalkylene oxides and derivatives such as the ethers, the esters and the amines thereof, thioether compounds, thiomorpholines, quaternary ammonium salt compounds, urethane derivatives, urea derivatives, imidazole derivatives, 3-pyrazolidones and so on in order to increase the sensitivity and the contrast thereof, or in order to accelerate the developing rate thereof. Examples of compounds are described in, for example, U.S. Pat. Nos. 2,400,532; 2,423,549; 2,716,062; 3,617,280; 3,772,021 and 3,808,003; and so on.

As a binder or a protective colloid for photographic emulsions, gelatin is used to advantage. However, other hydrophillic colloids can be also employed.

Specific examples of hydrophilic colloids which can be used include various kinds of synthetic hydrophilic macromolecular substances such as proteins, e.g., gelatin derivatives, graft polymers of gelatin and other macromolecules, albumine, casein and the like; sugar derivatives, e.g., cellulose derivatives, e.g., carboxymethyl cellulose, cellulose sulfuric acid esters or hydroxyethyl cellulose, sodium alginate, starch derivatives and the like; homo- or copolymers of polyvinyl alcohol, polyvinyl alcohol partial acetal, poly-N-vinylpyrrolidone, polyacrylic acid, polymethacrylic acid, polyacryl amide, polyvinylimidazole, polyvinylpyrazole and the like.

In addition to lime processed gelatin it is possible to use acid processed gelatin and enzyme processed gelatin as described in *Bull Soc. Sci. Photo. Japan,* No. 16, p. 30 (1966) and further, hydrolyzed products of gelatin and enzymatic degradation products of gelatin can be employed as gelatin. Examples of gelatin derivatives which can be used include those obtained by reacting gelatin with various kinds of compounds such as acid halides, acid anhydrides, isocyanates, bromoacetic acid, alkane sultones, vinyl sulfonamides, maleinimide compounds, polyalkylene oxides, epoxy compounds and so on. Specific examples of the gelatin derivatives are described in U.S. Pat. Nos. 2,614,928; 3,132,945; 3,186,846 and 3,312,553; British Pat. Nos. 861,414; 1,033,189 and 1,005,784; published examined Japanese patent application No. 26845/67; and so on.

Examples of the above-described graft polymers of gelatin which can be used include those obtained by grafting gelatin on homo- or co-polymers of vinyl monomers such as acrylic acid, methacrylic acid, the esters of these acids, the amides of these acids, acrylonitrile, styrene and so on. Especially preferable graft polymers are gelatins grafted with polymers having a certain measure of compatibility with gelatin, such as polyacrylic acid, polymethacrylic acid, polyacrylamide, polymethacrylamide, polyhydroxyalkylmethacrylates and the like. Specific examples of these graft polymers are described in U.S. Pat. Nos. 2,763,625; 2,831,767 and 2,956,884; and so on.

Representatives of synthetic hydrophilic macromolecular substances which can be used are those described in West German patent application (OLS) No. 2,312,708; U.S. Pat. Nos. 3,620,751 and 3,879,205; and published examined Japanese Patent Application 7561/68.

Various compounds can be incorporated in Photographic emulsions to be employed in the present invention with the intention of preventing the light-sensitive materials from being fogged in the course of production, preservation or photographic processings thereof, or stabilizing photographic properties thereof. That is, many compounds known as antifoggants or stabilizers can be added to the emulsions of the present invention. Specific examples of these compounds include azoles such as benzothiazolium salts, nitroindazoles, triazoles, benzotriazoles, benzimidazoles, (especially nitro- or halogen-substituted ones) and the like; heterocyclic mercapto compounds such as mercaptothiazoles, mercapto benzothiazoles, mercaptobenzoimidazoles, mercaptothiadiazoles, mercaptotetrazoles, (especially 1-phenyl-5-mercaptotetrazole), mercaptopyrimidines and the like; the above-described heterocyclic mercapto compounds containing water soluble groups such as carboxyl group or sulfo group; thioketo compounds such as oxazolinethione and the like; azaindenes such as tetrazaindenes, (especially 4-hydroxy substituted (1,3,3a,7)tetrazaindenes) and the like; benzene thiosulfonates; benzene sulfinates; and so on.

For more details of the compound examples and the usage of these agents descriptions in U.S. Pat. Nos. 3,954,474; 3,982,947 and 4,021,248; and published examined Japanese patent application No. 28660/77 can be referred to.

Photographic light-sensitive materials of the present invention may contain inorganic or organic hardeners in their photographic emulsion layers and other hydrophilic colloidal layers. Examples of hardeners which can be used include chromium salts (chrome alum, chromium acetate, etc.), aldehydes (formaldehyde, glyoxal, glutaraldehyde, etc.), N-methylol compounds (dimethylolurea, methyloldimethyl-hydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), and combinations of two or more of these hardeners.

Photographic emulsion layers and other hydrophilic colloidal layers of the light-sensitive materials of the present invention may contain various kinds of surface active agents for a wide variety of purposes, for example, as a coating aid, as an antistatic agent, improvement of sliding properties, improvement in emulsifying dispersion, prevention of adhesion, improvement of photographic characteristics (e.g., acceleration of development, high contrast and sensitization) and so on.

Examples of surface active agents which can be used include nonionic surface active agents such as saponin (steroid system), alkyleneoxide derivatives (polyethylene glycol, polyethylene glycol-polypropylene glycol condensate, polyethylene glycol alkyl ethers, polyethylene glycol alkyl aryl ethers, polyethylene glycol esters, polyethylene glycol sorbitan esters, polyalkylene glycol alkylamines or amides, polyethylene oxide adducts of silicone, etc.), glycidol derivatives (alkenylsuccinic acid polyglycerides, alkylphenol polyglycerides, etc.), fatty acid esters of polyhydric alcohols, alkyl esters of sugar, and so on; anionic surface active agents containing acidic groups, e.g., a carboxyl group, a sulfo group, a phospho group, a sulfuric acid ester group, a phosphoric acid ester group, etc., such as alkylcarboxylates, alkylsulfonates, alkylbenzene sulfonates, alkylnaphthalene sulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, and the like; amphoteric surface active agents such as amino acids, aminoalkylsulfonic acids, aminoalkylsulfuric acid esters, aminoalkylphosphoric acid esters, alkylbetaines, amine oxides, and the like; and cationic surface active agents such as alkylamine salts, aliphatic or aromatic quaternary ammonium salts, aliphatic and heterocyclic ring-containing phosphonium or sulfonium salts, and the like.

The photographic emulsion layers which can constitute photographic light-sensitive materials of the present invention can contain color-image forming couplers, that is, compounds capable of forming colors through the oxidative coupling reactions with aromatic primary amine developers (e.g., phenylene diamine derivatives, aminophenol derivatives, etc.) in the color development processing. 5-Pyrazolone couplers, pyrazolobenzimidazole couplers, cyanoacetylcumarone couplers, open-chain acylacetonitrile couplers and the like can be employed as magenta couplers. Acylacetoamide couplers (e.g., benzoyl acetoanilides and pivaloyl acetoamilides) can be employed as yellow couplers. Naphthol couplers and phenol couplers can be employed as cyan couplers. These couplers are desired to have hydrophobic groups named ballast groups in their individual molecules to render them nondiffusible. These couplers may be two-equivalent, or four-equivalent to silver ion. Colored couplers possessing a color correcting effect, or development-inhibiting compound-releasing type couplers (the so-called DIR couplers) may be incorporated in the photographic emulsion layers. Also, colorless DIR coupling compounds which produce colorless compounds in the coupling reaction and that, can release development-inhibiting compounds may be incorporated therein.

The photographic emulsions of the present invention can contain dye image forming compounds to be employed in the so-called diffusion transfer photographs (e.g., dye developers, dye releasing redox compounds, DDR couplers, etc.). Specific examples of these compounds are described in, e.g., U.S. Pat. Nos. 4,053,312; 4,055,428; 4,076,529; 4,152,153 and 4,135,929: published unexamined Japanese patent applications No. 149328/78, 104343/76, 46730/78, 130122/79, 3819/78, 12642/81, 16130/81 and 16131/81.

The silver halide emulsions can contain developing agents. Examples of suitable developing agents which can be employed are described in "Developing Agents" *Research Disclosure,* vol. 176, p. 29.

The photographic emulsion layers and/or other hydrophilic colloidal layers of the light-sensitive material produced in accordance with the present invention may contain dyes such as a filter dye, an anti-halation dye or dyes for the other purposes. Examples of such dyes are those described in "Absorbing and Filter Dyes" *Research Disclosure,* vol. 176, pp. 25–26.

The silver halide photographic emulsions may additionally contain antistatic agents, plasticizers, matting agents, lubricants, ultraviolet light-absorbing agents, brightening agents, aerial fog-preventing agents and so on.

The silver halide emulsions are coated on a support, optionally together with other photographic layers. Suitable coating techniques which can be used are described in "Coating Procedures" *Research Disclosure,* vol. 176, pp. 27–28. Suitable supports which can be used are described in "Support" *Research Disclosure,* vol. 176, p. 28.

The silver halide photographic emulsions of the present invention can be used for various purposes, for example, as color positive emulsions, as color paper emulsions, as color negative emulsions, as color reversal emulsions (with or without couplers), as emulsions for photographic light-sensitive materials suitable for graphic arts (e.g., lithographic films), as emulsions used in light-sensitive materials for recording a cathode-ray tube display, as emulsions used in light-sensitive materials for X-ray recording (, especially for X-ray photography and photofluorography utilizing a screen), as emulsions employed for the colloid transfer process (e.g., as described in U.S. Pat. No. 2,716,059), as emulsions for the silver salt diffusion transfer process (e.g., as described in U.S. Pat. Nos. 2,352,014; 2,543,181; 3,020,155; 2,861,885; and so on), as emulsions for the color diffusion transfer process (e.g., as described in U.S. Pat. Nos. 3,087,817; 3,185,567; 2,983,606; 3,253,915; 3,227,550; 3,227,551; 3,227,552; 3,415,644; 3,415,645 and 3,415,646; *Research Disclosure,* vol. 151, No. 15162, pp. 75–87

(Nov. 1976); and so on), as emulsions employed for the dye transfer process (imbibition transfer process) (e.g., as described in U.S. Patent 2,882,156; and so on), as emulsions employed for the silver dye bleach process (as described in Friedman, *History of Color Photography,* American Photographic Publishers Co. (1944), particularly Chapter 24, *British Journal of Photography,* vol. 111, pp. 308–309 (April 7, 1964), and so on), as emulsions employed for direct positive light-sensitive materials (e.g., as described in U.S. Pat. Nos. 2,497,875; 2,588,982; 3,367,778; 3,501,306; 3,501,305; 3,672,900; 3,477,852; 2,717,833; 3,023,102; 3,050,395; 3,501,307 and so on), as emulsions employed for heat developable light-sensitive materials (as described in U.S. Pat. Nos. 3,152,904; 3,312,550 and 3,148,122; British Pat. No. 1,110,046; and so on), as emulsions employed for light-sensitive materials for physical development (e.g., as described in British Pat. Nos. 920,277 and 1,131,238; and so on), and so on.

In particular, the emulsions of the present invention can be utilized to advantage as emulsions for multilayered coupler-in-emulsion type of color films, especially reversal color and negative color films, emulsions for black-and-white negative films (including black-and-white highly sensitive negative films, micro negatives and so on), emulsions for the color diffusion transfer process, and emulsions for direct positive light-sensitive materials.

The exposure for obtaining a photographic image may be carried out in a conventional manner. Any various known light sources including natural light (sun light), a tungsten lamp, a fluorescent lamp, a mercury lamp, a xenon arc lamp, a carbon arc lamp, a xenon flash lamp, cathode-ray tupe flying spot and so on can be employed for the exposure. Suitable exposure times which can be used include not only exposure times commonly used in cameras ranging from about 1/1000 to about 1 sec., but also exposure times shorter than 1/1000 sec., for example, about $1/10^4$ to about $1/10^6$ sec. as used with xenon flash lamps and cathode-ray tubes. Exposure times longer than 1 sec. can be also used. The spectral distribution of the light used for the exposure can be controlled using color filteres, if desired. Laser beams can be also employed for the exposure. Moreover, the emulsions of the present invention may be exposed to light emitted from phosphors excited by electron beams, X-rays, $\gamma$-rays, $\alpha$-rays and the like.

Any known methods for photographic processings can be applied to the light-sensitive materials produced using the emulsions of the present invention. Any known processing solutions can be employed. A processing temperature is usually chosen from a preferred range of 18° C. to 50° C. However, temperatures lower than 18° C., or temperatures higher than 50° C. may be employed. Either black-and-white photographic processing comprising a developing step for forming silver image, or color photographic processing comprising a developing step for forming dye images can be applied depending upon the end-use purpose of the emulsions of the present invention.

Developing solutions which can be used in the black-and-white photographic processing include all known developing agents. Specific examples of developing agents which can be employed include dihydroxybenzenes (e.g., hydroquinone, etc.), 3-pyrazolidones (e.g., 1-phenyl-3-pyrazolidone, etc.), aminophenols (e.g., N-methyl-p-aminophenol, etc.), 1-phenyl-3-pyrazolines, ascorbic acid, such heterocyclic compounds as to be formed by condensation of a 1,2,3,4-tetrahydroquinone ring and an indolene ring which are described in U.S. Pat. No. 4,067,872; and combinations of two or more thereof. In addition to the developing agents as described above, the developing solution may further contain known additives, such as a preservative, an alkali agent, a pH buffering agent, an antifoggant and optionally, a dissolving aid, a color toning agent, a development accelerator, a surface active agent, a deforming agent, a water softener, a hardening agent, a viscosity imparting agent and so on.

A so-called "litho" type of development processing can be applied to the photographic emulsions of the present invention. The term litho type of development processing means that a developing process is allowed to run infectiously, usually using dihydroxybenzenes as a developing agent under the condition of low sulfite ion concentrations for the purpose of photographic reproduction of line images, or photographic reproduction of halftone images consisting of dots (L. F. A. Mason, *Photographic Processing Chemistry,* pp. 163–165 (1966) should be referred to for details of the litho type of developing processing).

As a special form of development processing, a method wherein a light-sensitive material used contains a developing agent therein, for example, in its emulsion layer, and development is carried out by treating the light-sensitive material with an alkaline aqueous solution can be employed. Hydrophobic developing agents can be incorporated in the emulsion layers in a form of latex dispersion, as disclosed as RD-16928 in *Research Disclosure,* vol. 169. The development processing as described above may be carried out in combination with the silver salt stabilizing processing using thiocyanates.

Fixing solutions which can be used include all of generally used fixing compositions.

Examples of fixing agents which can be used include not only thiosulfates and thiocyanates, but also organic sulfur compounds which have been known to have a fixing effect.

The fixing solutions may contain water soluble aluminium salts as a hardener.

Dye images can be formed according to conventional processes. Examples of the process which can be employed include the negative-positive process (e.g., as described in *Journal of the Society of Motion Picture and Television Engineers,* vol. 61, pp. 667–701 (1953); the color reversal process wherein negative silver image is produced by development with a developing solution containing a black-and-white developing agent and then, the silver image is subjected to uniform exposure or another appropriate fogging processing for at least one time and subsequently, to a color development processing; the silver dye bleaching process wherein silver image is formed by developing an optically exposed dye-containing photographic emulsion and dyes are bleached by using the silver image formed as a bleaching catalyst, and so on.

Color developing solutions are generally alkaline aqueous solutions containing color developing agents. Specific examples of color developing agents which can be employed include known aromatic primary amine developers such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-β-methoxyethylaniline, etc.) and so on.

Besides the above-described color developing agents, those described in L. F. A. Mason, *Photographic Processing Chemistry*, pp. 226–229, Focal Press, London (1966), U.S. Pat. Nos. 2,193,015 and 2,592,364; published unexamined Japanese Patent Application 64933/73; and so on may be employed.

The color developing solution can additionally contain a pH beffering agent such as a sulfite, a carbonate, a borate or a phosphate of an alkali metal; a development inhibitor or an antifoggant, such as a bromide, an iodide and an organic antifoggant; and so on. The color developing solution may optionally contain a water softener, a preservative like hydroxylamine, organic solvents such as benzyl alcohol and diethylene glycol, a development accelerator such as polyethylene glycols, quaternary ammonium salts or amines, dye forming couplers, competing couplers, a fogging agent like sodium borohydride, an auxiliary developing agent like 1-phenyl-3-pyrazolidone, a viscosity imparting agent, a polycarboxylic acid series chelating agent described in U.S. Pat. No. 4,083,723; an antioxidant described in West Germany patent application (OLS) 2,622,950; and so on.

After the color development processing, the photographic emulsion layers are generally subjected to a bleaching processing. The bleaching processing may be carried out simultaneously with the fixing processing, or they may be carried out separately. Examples of bleaching agents which can be used include compounds of polyvalent metals such as iron (III), cobalt (III), chromium (IV), copper (II), etc., peroxides, quinones nitroso compounds and so on. More specifically, ferricyanides, dichromates, organic complex salts of iron (III) or cobalt (III), for example, Fe(III) or Co(III) complex salts of aminopolycarboxylic acids such as ethylenediaminetetraacetic acid, nitrilo-triacetic acid, 1,3-diamino-2-propanoltetraacetic acid, etc., or those of organic acids such as citric acid, tartaric acid, malic acid, etc.; persulfate, permanganates; nitrosophenol; and so on. Among these bleaching agents, potassium ferricyanide, sodium ethylenediaminetetraacetatoferrate(III) and ammonium ethylenediaminetetraacetatoferrate(III) are particularly useful. (Ethylenediaminetetraacetato) iron(III) complexes are useful in both the independent bleaching solution and the combined bleaching and fixing solution.

The bleaching or the combined bleaching and fixing solution can contain a bleaching accelerator as described in U.S. Pat. Nos. 3,042,520 and 3,241,966; published examined Japanese patent application Nos. 8506/70 and 8836/70; and so on, a thiol compound as described in published unexamined Japanese patent application No. 65732/78, and additionally, other various additives.

EXAMPLE 1

An aqueous solution of a potassium bromide-potassium iodide mixture and an aqueous solution of silver nitrate were simultaneously added dropwise to an aqueous solution of gelatin over a period of 45 minutes at a temperature of 65° C. with vigorous stirring to produce a silver iodobromide emulsion having an iodide content of 1.8 mole% (Emulsion 1). The pAg of the reaction mixture was maintained at about 8.5 during the silver halide precipitation. The resulting emulsion was washed with water in a conventional manner. The mean grain diameter of the emulsion obtained was about 0.21 micron.

Other emulsionns were prepared in the same manner as Emulsion 1 except that compounds of the present invention, and comparative compounds being ammonia and disodium ethylenediaminetetraacetate were added to the aqueous solutions of gelatin respectively according to their respective formulae described in Table 1. A mean grain size of each of the thus obtained emulsions was measured using an electron microscope.

As can be seen from Table 1, the compounds of the present invention can increase grain sizes of silver halides in a manner similar to ammonia.

Since the compounds of the present invention do not evolve any ill-smelling gases, unlike ammonia, they are handled with ease. In addition, they ensure safety in handling.

TABLE 1

| Emulsion No. | Compound | Addition Amount mole/mole Ag | Mean Grain Size micron |
|---|---|---|---|
| 1 (control) | — | — | 0.21 |
| 2 | Compound (1) | 0.05 | 0.37 |
| 3 | Compound (1) | 0.17 | 0.91 |
| 4 | Compound (2) | 0.04 | 0.38 |
| 5 | Compound (2) | 0.15 | 0.90 |
| 6 | Compound (4) | 0.10 | 0.57 |
| 7 | Compound (9) | 0.10 | 0.61 |
| 8 | Compound (12) | 0.14 | 0.88 |
| 10 (Comparison) | Ammonia | 0.07 | 0.38 |
| 11 (Comparison) | Ammonia | 0.23 | 0.91 |
| 12 (Comparison) | Disodium Ethylenediaminetetraacetate | 0.04 | 0.25* |

*Aggregation of silver halide grains occurred.

EXAMPLE 2

The emulsions prepared in Example 1 were divided into two groups depending on the mean grain size of silver halide therein. In each group, each emulsion was chemically ripened using sodium thiosulfate and potassium chloroaurate at a temperature of 55° C. under optimum conditions.

To each of the thus obtained emulsions were added 4-hydroxy-6-methyl-1,3,3a,7-tetrazaindene, sodium 2,4-dichloro-6-hydroxy-s-triazine and sodium dodecylbenzenesulfonate. The resulting emulsion was coated on a cellulose acetate film support, and dried.

Each of the coated samples was exposed through an optical wedge, developed for five minutes at 20° C. in Kodak developer D-19, stopped, fixed, washed and dried with the results shown in Table 2 and Table 3.

For expressing relative sensitivity, the relative value of the reciprocal of exposure amount required for obtaining the optical density of fog +0.2 was employed. In Table 2, the relative sensitivity of Emulsion 10 (Sample 21) was taken as 100. On the other hand, the relative sensitivity of Emulsion 11 (Sample 31) was taken as 100 in Table 3.

TABLE 2

(Mean Grain Size: about 0.38 micron)

| Sample No. | Emulsion No. | Relative Sensitivity | Fog | Gamma |
|---|---|---|---|---|
| 21 | Emulsion 10 (Ammonia) | 100 | 0.05 | 3.7 |
| 22 | Emulsion 2 (Compound 1) | 98 | 0.03 | 4.0 |
| 23 | Emulsion 4 (Compound 2) | 100 | 0.03 | 3.9 |
| Comparison | Emulsion 1 | 28 | 0.03 | 5.2 |

TABLE 2-continued

| Sample No. | Emulsion No. | Relative Sensitivity | Fog | Gamma |
|---|---|---|---|---|
| | (Mean Grain Size: about 0.38 micron) | | | |
| Comparison | Emulsion 12 (EDTA 2Na) | 45 | 0.18 | 4.1 |

TABLE 3

| Sample No. | Emulsion No. | Relative Sensitivity | Fog | Gamma |
|---|---|---|---|---|
| | (Mean Grain Diameter: about 0.9 micron) | | | |
| 31 | Emulsion 11 (Ammonia) | 100 | 0.09 | 1.5 |
| 32 | Emulsion 3 (Compound 1) | 100 | 0.06 | 1.7 |
| 33 | Emulsion 5 (Compound 2) | 98 | 0.06 | 1.7 |
| 34 | Emulsion 8 (Compound 12) | 95 | 0.06 | 1.6 |

As can be seen from Table 2 and Table 3, the sensitivities of the emulsions using the compounds of the present invention are nearly equal to that of the emulsion using ammonia when mean grain sizes of these emulsions are nearly equal to one another. In addition, the emulsions of the present invention generate reduced fog, and exhibit increased gamma, compared with the emulsion using ammonia.

When disodium ethylenediaminetetraacetate is employed, the emulsion is liable to generate fog, notwithstanding the not large mean grain size.

EXAMPLE 3

In order to examine reproducibility of emulsion precipitation, a preparation of Emulsions 3, that of Emulsion 5, and that of Emulsion 11 each was repeated 5 times according to the same program. After every preparation, the mean grain size of each emulsion was measured. The range in which mean grain sizes varied with every time of preparation was determined with respect to each emulsion. The results obtained are shown below.

TABLE 4

| Emulsion | Range of Mean Grain Sizes |
|---|---|
| Emulsion 3 (Compound 1) | 0.91 ± 0.04 micron |
| Emulsion 5 (Compound 5) | 0.90 ± 0.04 micron |
| Emulsion 11 (Ammonia) | 0.91 ± 0.09 micron |

It can be seen from the above-described results that the emulsions made in the presence of the compounds of the present invention exhibited excellent reproducibility with respect to the grain sizes of silver halides, compared with the emulsion made in the presence of ammonia, and the compounds of the present invention can remarkably improve upon the stability (reproducibility) of the grain forming step.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material, comprising:

a support base;

a silver halide emulsion layer on the support base, the emulsion layer comprising silver halide grains, wherein the grains are formed in the presence of a compound represented by the following general formula (I):

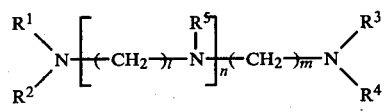

(I)

wherein l and m are 2 or 3; n is 0, 1 or 2; and $R^1$ to $R^5$ are independently an alkyl group, a hydroxyalkyl group or a carboxyalkyl group, and when n is zero, at least one substituent of $R^1$ to $R^4$ is a hydroxyalkyl group, and when n is not zero, at least two substituents of $R^1$ to $R^5$ are each a hydroxyalkyl group.

2. A photographic light-sensitive material as claimed in claim 1, wherein $R^1$ to $R^5$ independently represent compounds containing 6 or less carbon atoms.

3. A photographic light-sensitive material as claimed in claim 2, wherein the emulsion containns about $10^{-4}$ mole to about 5 moles of the compound represented by general formula (I) per mole of the silver halide.

4. A photographic light-sensitive material as claimed in claim 3, wherein the amount of the compound represented by general formula (I) is from about $10^{-3}$ mole to about 2.5 moles of per mole of silver halide.

5. A photographic light-sensitive material as claimed in claim 2, wherein the silver halide grains have a mean grain diameter 0.1 microns to about 5 microns.

6. A photographic light-sensitive material as claimed in claim 5, wherein the silver halide grains have a mean grain diameter of about 0.2 microns to about 3 microns.

7. A photographic light-sensitive material as claimed in claim 1, wherein the compound represented by the general formula (I) is a compound represented by the following general formula (II):

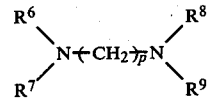

wherein p is 2 or 3; and $R^6$ to $R^9$ may be different from one another, but at least one of them is a hydroxyalkyl group and the residual substituents are alkyl groups.

* * * * *